US005148946A

United States Patent [19]

Mizuta et al.

[11] Patent Number: 5,148,946

[45] Date of Patent: Sep. 22, 1992

[54] METHOD AND APPARATUS FOR DELIVERING PREDETERMINED AMOUNTS OF FLUIDS

[75] Inventors: Akira Mizuta; Takeaki Shibuya, both of Kanagawa, Japan

[73] Assignee: Fuji Photo Film Co., Ltd., Kanagawa, Japan

[21] Appl. No.: 581,354

[22] Filed: Sep. 12, 1990

[30] Foreign Application Priority Data

Sep. 13, 1989 [JP] Japan ..... 1-237883

[51] Int. Cl.[5] ..... B67B 7/00

[52] U.S. Cl. ..... 222/1; 222/394; 222/504; 222/548; 137/624.13; 251/171

[58] Field of Search ..... 222/1, 639, 394, 399, 222/400.7, 542, 548, 568, 553, 504; 239/581.1, 581.2, 99; 118/684; 137/624.13; 251/214, 171

[56] References Cited

U.S. PATENT DOCUMENTS

| | | | |
|---|---|---|---|
| 3,913,612 | 10/1975 | Tolnai | 251/171 X |
| 4,328,974 | 5/1982 | White et al. | 251/214 X |
| 4,671,314 | 6/1987 | Heil | 222/553 X |
| 4,798,314 | 1/1989 | Worth et al. | 222/542 |
| 4,802,508 | 2/1989 | Styles | 137/624.13 |
| 4,922,852 | 5/1990 | Price | 118/684 X |

FOREIGN PATENT DOCUMENTS

| | | | |
|---|---|---|---|
| 563262 | 9/1958 | Canada | 118/681 |
| 51-80005 | 9/1976 | Japan . | |
| 56-92817 | 12/1981 | Japan . | |

*Primary Examiner*—Gregory L. Huson
*Attorney, Agent, or Firm*—Sughrue, Mion, Zinn Macpeak & Seas

[57] ABSTRACT

A method for delivering a predetermined amount of a fluid comprises the steps of pressurizing the fluid, passing it through a pressure feed passageway, opening and closing the pressure feed passageway, and thereby delivering a predetermined amount of the fluid out of the pressure feed passageway. A rotatable shaft is located in the pressure feed passageway. The rotatable shaft is provided with a passageway part, which constitutes part of the pressure feed passageway. The fluid is delivered by rotating the rotatable shaft to a predetermined orientation, in which the passageway part communicates with the pressure feed passageway outside of the passageway part. After a predetermined amount of the fluid has been delivered, the rotatable shaft rotates by a predetermined angle to an orientation, in which the passageway part does not communicate with the pressure feed passageway outside of the passageway part, and the delivery of the fluid is thereby stopped.

10 Claims, 3 Drawing Sheets

METHOD AND APPARATUS FOR DELIVERING PREDETERMINED AMOUNTS OF FLUIDS

BACKGROUND OF THE INVENTION

1. Field of the Invention

This invention relates to a method for delivering a predetermined amount of a fluid wherein the fluid is pressurized and passed through a pressure feed passageway, the pressure feed passageway is opened and closed, and a predetermined amount of the fluid is thereby delivered out of the pressure feed passageway. This invention also relates to an apparatus for carrying out the method.

2. Description of the Prior Art

One of conventional apparatuses for delivering a predetermined amount of a fluid is disclosed in, for example, Japanese Unexamined Utility Model Publication No. 56(1981)-92817. With the disclosed apparatus, a piston is moved vertically in order to deliver a fluid out of a needle and to stop delivering the fluid.

However, with the disclosed apparatus for delivering a predetermined amount of a fluid, when the piston stops delivering the fluid out of the needle, the portion of the fluid, which is present in a fluid outlet part of the needle, flows back to a fluid reservoir region, which is located above the needle. As the portion of the fluid thus flows from the fluid outlet part of the needle back to the fluid reservoir region, air is sucked into the fluid outlet part of the needle. Specifically, the volume of the fluid pushing edge part of the piston, which is located in the fluid reservoir region, changes as the piston moves vertically in order to deliver the fluid and to stop delivering the fluid. When the piston stops delivering the fluid, the volume of the fluid pushing edge part of the piston, which is located in the fluid reservoir region, becomes smaller than when the piston works to deliver the fluid. As a result, when the piston stops delivering the fluid, the pressure in the fluid reservoir region becomes negative, and the portion of the fluid, which is present in the fluid outlet part of the needle, flows back to the fluid reservoir region. Therefore, air is sucked into the fluid outlet part of the needle.

Because the portion of the fluid, which is present in the fluid outlet part of the needle, flows back to the fluid reservoir region when the piston stops delivering the fluid, the portion of the fluid can be prevented from undesirably falling from the fluid outlet of the needle when the piston stops delivering the fluid. However, as described above, air is sucked into the fluid outlet part of the needle. Therefore, the problem occurs in that, when the fluid is thereafter delivered from the fluid outlet part of the needle, air thus sucked thereinto gets mixed with the fluid.

By way of example, in cases where the fluid which is to be delivered is a liquid adhesive, if air gets mixed with the adhesive, the problems described below occur. Specifically, when the adhesive containing air is delivered and applied to a material which is to be adhered, bubbles occur in the adhesive layer thus applied. Therefore, the adhesion strength becomes low at parts in the vicinity of the bubbles. Also, in cases where the material to be adhered is flexible, the material which has been adhered by the adhesive containing bubbles will get distorted at parts in the vicinity of the bubbles.

SUMMARY OF THE INVENTION

The primary object of the present invention is to provide a method for delivering a predetermined amount of a fluid such that, when delivery of the fluid is stopped, the portion of the fluid, which is present in a fluid outlet part, does not flow back, no air gets mixed with the fluid, and no fluid falls undesirably.

Another object of the present invention is to provide a method for very accurately delivering a predetermined amount of a fluid.

The specific object of the present invention is to provide an apparatus for carrying out the method.

The present invention provides a method for delivering a predetermined amount of a fluid wherein the fluid is pressurized and passed through a pressure feed passageway, the pressure feed passageway is opened and closed, and a predetermined amount of the fluid is thereby delivered out of the pressure feed passageway, the method for delivering a predetermined amount of a fluid comprising the steps of:

i) locating a rotatable shaft in said pressure feed passageway, said rotatable shaft being provided with a passageway part, which constitutes part of said pressure feed passageway, ii) delivering said fluid by rotating said rotatable shaft to a predetermined orientation, in which said passageway part communicates with said pressure feed passageway outside of said passageway part, and iii) after a predetermined amount of said fluid has been delivered, rotating said rotatable shaft by a predetermined angle to an orientation, in which said passageway part does not communicate with said pressure feed passageway outside of said passageway part, and thereby stopping the delivery of said fluid.

The present invention also provides a first apparatus for delivering a predetermined amount of a fluid, the apparatus comprising:

i) a means for pressurizing said fluid, ii) a pressure feed passageway through which said pressurized fluid passes, and iii) a dispenser located in said pressure feed passageway, said dispenser being provided with:

a) a rotatable shaft provided with a passageway part, which constitutes part of said pressure feed passageway, b) an operation means for rotating said rotatable shaft, and c) a control means for controlling said operation means in order for said rotatable shaft to be rotated to an orientation, in which said passageway part communicates with said pressure feed passageway outside of said passageway part, and to an orientation, in which said passageway part does not communicate with said pressure feed passageway outside of said passageway part.

The present invention further provides a second apparatus for delivering a predetermined amount of a fluid, wherein said dispenser is further provided with:

a cylindrical part of a housing, which cylindrical part is fitted outside of said rotatable shaft such that said rotatable shaft can rotate therein, a seal member which is constituted of a resilient material and has a convex conical edge surface, which edge surface is taken in the axial direction, said seal member being located between said cylindrical part of the housing and said rotatable shaft such that an outer circumferential surface of said seal member is in contact with an inner circumferential surface of said cylindrical part of the housing, and an inner circumferential surface of said seal member is in contact with an outer circumferential surface of said rotatable shaft, and a seal pushing member having a concave conical pushing surface, which corresponds to said convex conical edge surface of said seal member and which pushes said convex conical edge surface of said seal member along the axial direction.

With the method and apparatuses for delivering a predetermined amount of a fluid in accordance with the present invention, the delivery of the fluid is stopped by rotating the rotatable shaft. Therefore, when the delivery of the fluid is stopped, the fluid is subjected to no large force (for example, force occurring from a change in pressure due to a change in the volume of a body, such as a fluid pushing edge part of a piston, in the fluid as in the aforesaid conventional apparatus for delivering a predetermined amount of a fluid). Accordingly, the method and apparatuses for delivering a predetermined amount of a fluid in accordance with the present invention are free of the problems in that the fluid falls undesirably and air is sucked into a fluid outlet part of a needle when the delivery of the fluid is stopped. As a result, a predetermined amount of the fluid can be delivered very accurately.

Also, with the second apparatus for delivering a predetermined amount of a fluid in accordance with the present invention, the convex conical edge surface of the resilient seal member is pushed by the concave conical pushing surface of the seal pushing member. Therefore, the seal member is deformed by the pushing force of the seal pushing member. Particularly, the inner circumferential surface of the seal member is pushed with a predetermined, sufficient pushing force against the outer circumferential surface of the rotatable shaft. Accordingly, the outer circumferential surface of the rotatable shaft can be reliably sealed by the seal member.

DESCRIPTION OF THE PREFERRED EMBODIMENTS

The present invention will hereinbelow be described in further detail with reference to the accompanying drawings.

Figure 1:
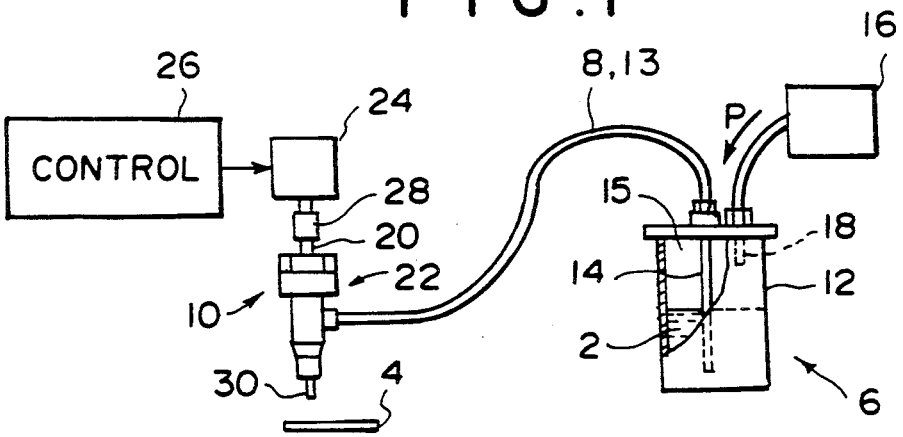
FIG. 1 is a schematic view showing an embodiment of the apparatus for delivering a predetermined amount of a fluid in accordance with the present invention.

FIG. 1 is a schematic view showing an embodiment of the apparatus for delivering a predetermined amount of a fluid in accordance with the present invention.

With reference to FIG. 1, a predetermined amount of a liquid adhesive 2 is delivered and applied to a material 4, which is to be adhered. The embodiment illustrated comprises a pressurization means 6 for pressurizing the adhesive 2, a pressure feed passageway 8 through which the pressurized adhesive 2 passes, and a dispenser 10 which is located in the pressure feed passageway 8 and which delivers a predetermined amount of the adhesive 2 by opening and closing the pressure feed passageway 8.

The pressurization means 6 comprises a sealed pressure vessel 12 for accommodating the adhesive 2, and a delivery pipe 14 which is inserted in the pressure vessel 12. One edge of the delivery pipe 14 is immersed in the adhesive 2, and the other edge thereof is connected to a pressure feed pipe 13, which constitutes the pressure feed passageway 8. The pressurization means 6 also comprises a pressure supply pipe 18 which is inserted in the pressure vessel 12. One edge of the pressure supply pipe 18 is located in an upper space 15 above the upper surface of the adhesive 2, and the other edge thereof is connected to a pressure supply means 16, which may be constituted of an air compressor, or the like.

With the pressurization means 6, the pressure supply means 16 supplies a predetermined pressure (e.g. pressurized air) to the upper space 15 in the pressure vessel 12. The adhesive 2 accommodated in the pressure vessel 12 is thereby pressurized and supplied through the delivery pipe 14 and the pressure feed passageway 8 to a dispenser body of the dispenser 10.

The dispenser 10 comprises a dispenser body 22 provided with a rotatable shaft 20, which opens and closes the pressure feed passageway 8 in order to deliver a predetermined amount of the adhesive 2. The dispenser 10 also comprises a pulse motor 24, which serves as an operation means and which rotates the rotatable shaft 20, and a control means 26 for controlling the pulse motor 24. In FIG. 1, reference numeral 28 represents a coupling, and reference numeral 30 represents a needle.

Figure 2:
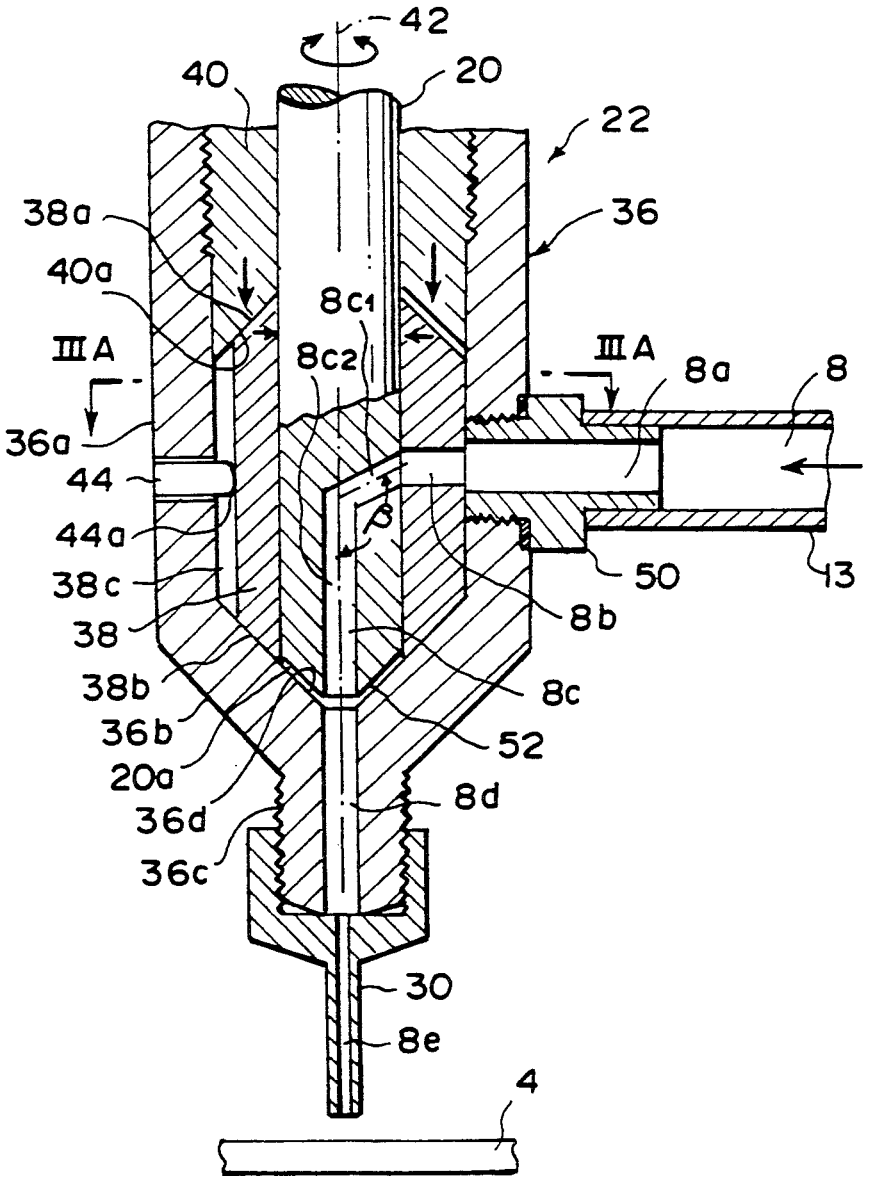
FIG. 2 is an enlarged sectional view showing the major part of the embodiment shown in FIG. 1.
Figure 3A:
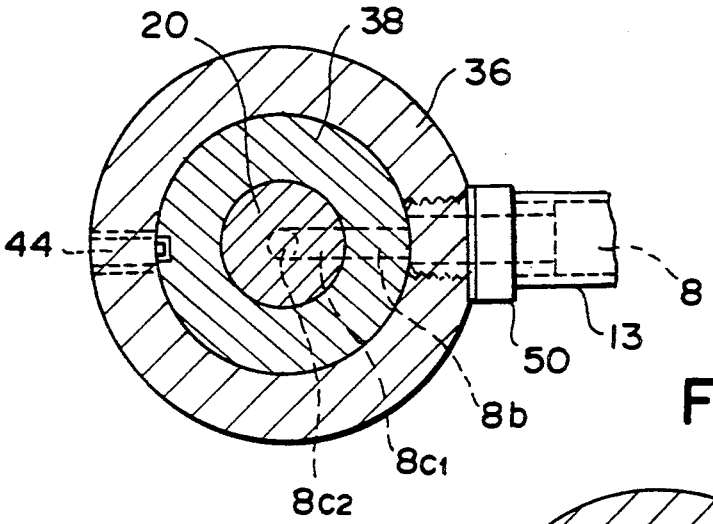
FIG. 3A is a sectional view taken along line IIIA—IIIA of FIG. 2 and showing how a rotatable shaft is oriented when a fluid is delivered.

FIG. 2 is an enlarged sectional view showing the major part (lower part) of the dispenser body 22. FIG. 3A is a sectional view taken along line IIIA—IIIA of FIG. 2 and showing how the rotatable shaft 20 is oriented when the adhesive 2 is delivered.

The dispenser body 22 is provided with a housing 36, and the rotatable shaft 20 which is located in the housing 36. The dispenser body 22 is also provided with a cylindrical seal member 38 which is located between the rotatable shaft 20 and the housing 36, and a seal pushing member 40 which pushes the seal member 38. The dispenser body 22 is further provided with the needle 30 which is fitted by threads onto a lower edge protrusion **36*c* of the housing 36**.

The housing 36 is provided with a cylindrical part **36*a*, a conical part 36*b* which is located under the cylindrical part 36*a*, and the lower edge protrusion 36*c* which is located under the conical part 36*b***.

The rotatable shaft 20 is inserted in the cylindrical part **36*a* of the housing 36 such that the axis of the rotatable shaft 20 coincides with an axis 42 of the cylindrical part 36***a*. The rotatable shaft 20 has a lower conical edge surface 20*a*, which faces an inner conical surface 36*d* of the conical part 36*b* of the housing 36.

The cylindrical seal member 38 is constituted of a resilient material, such as a fluorine resin or a high-density polyethylene resin, and is fitted on the rotatable shaft 20. The seal member 38 has an upper convex conical edge surface 38*a* and a lower convex conical edge surface 38*b*. A groove 38*c* is formed in the outer circumferential surface of the seal member 38 along the axis 42. The groove 38*c* engages with an stopper edge 44*a* of a stopper 44. which is fitted by threads in a hole formed through the wall of the cylindrical part 36*a* of the housing 36. The stopper edge 44*a* engages with the groove 38*c* such that the seal member 38 does not rotate when the rotatable shaft 20 rotates.

The seal pushing member 40 is formed in a cylindrical shape and fitted on the rotatable shaft 20. The seal pushing member 40 has external threads on its outer circumferential surface. The external threads engage with internal threads formed on the inner circumferential surface of the cylindrical part 36*a* of the housing 36. Also, the lower edge of the seal pushing member 40 constitutes a concave conical pushing surface 40*a*, which corresponds to the upper convex conical edge surface 38*a* of the seal member 38.

The seal pushing member 40 is rotated and moved down by a predetermined length in order to push and deform the resilient seal member 38. As a result, the inner circumferential surface of the seal member 38 is pushed against the outer circumferential surface of the rotatable shaft 20, so that the former surface is in close contact with the latter surface. Also, the outer circumferential surface of the seal member 38 is pushed against the inner circumferential surface of the cylindrical part 36*a* of the housing 36, so that the former surface is in close contact with the latter surface. Therefore, the outer circumferential surface of the rotatable shaft 20 is sealed by the seal member 38. Particularly, when the seal pushing member 40 pushes the seal member 38, the upper convex conical edge surface 38*a* of the seal member 38 is pushed by the concave conical pushing surface 40*a* of the seal pushing member 40. Therefore, the upper edge of the seal member 38 is pushed with a comparatively large force against the rotatable shaft 20 (in the radial direction of the rotatable shaft 20). Accordingly, the outer circumferential surface of the rotatable shaft 20 can be reliably sealed by the seal member 38. When the seal pushing member 40 pushes the seal member 38, the lower convex conical edge surface 38*b* of the seal member 38 is also pushed against the inner conical surface 36*d* of the conical part 36*b* of the housing 36.

A nipple 50 is fitted by threads with a hole, which is formed through the wall of the cylindrical part 36*a* of the housing 36. The nipple 50 is connected to the pressure feed pipe 13, which constitutes the pressure feed passageway 8. The internal hole of the nipple 50 constitutes a passageway part 8*a*, which constitutes part of the pressure feed passageway 8. Also, the seal member 38, the rotatable shaft 20, the lower edge protrusion 36*c* of the housing 36, and the needle 30 have through holes, which constitute passageway parts 8*b*, 8*c*, 8*d*, and 8*e*. The passageway parts 8*b*, 8*c*, 8*d*, and 8*e* constitute parts of the pressure feed passageway 8. The passageway parts 8*a* and 8*b* extend in the direction normal to the axis 42. The passageway parts 8*d* and 8*e* extend coaxially with the axis 42. The passageway part 8*c*, which is formed through the rotatable shaft 20, is constituted of a first passageway part 8*c*1 and a second passageway part 8*c*2. The first passageway part 8*c*1 extends in the direction approximately normal to the axis 42 (i.e. in the radial direction of the rotatable shaft 20). The first passageway part 8*c*1 slightly inclines downwardly toward the center line of the rotatable shaft 20. The second passageway part 8*c*2 extends coaxially with the axis 42.

How a predetermined amount of the adhesive 2 is delivered in the aforesaid embodiment will be described hereinbelow.

Figure 3B:
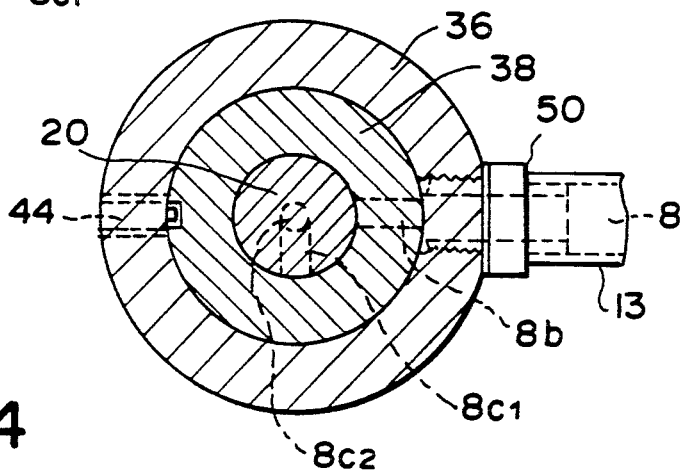
FIG. 3B is a sectional view taken along line IIIA—IIIA of FIG. 2 and showing how a rotatable shaft is oriented when the delivery of the fluid is stopped.

The upper part of the rotatable shaft 20 projects upwardly from the housing 36 and is connected by the coupling 28 to the pulse motor 24. The pulse motor 24 rotates the rotatable shaft 20. As illustrated in FIGS. 2 and 3A, the rotatable shaft 20 is rotated until its first passageway part 8*c*1 aligns and communicates with the passageway part 8*b*, which is formed through the seal member 38. As a result, the adhesive 2 passes through the pressure feed passageway 8, and the passageway parts 8*a*, 8*c*1, 8*c*2, 8*d*, and 8*e* and is delivered from the lower edge of the needle 30 to the material 4, which is to be adhered. After the adhesive 2 continues to be delivered for a predetermined time, the pulse motor 24 rotates the rotatable shaft 20 by an appropriate angle such that, as illustrated in FIG. 3B, the first passageway part 8*c*1 formed through the rotatable shaft 20 does not communicate with the passageway part 8*b* formed through the seal member 38. In this manner, the delivery of the adhesive 2 is stopped. The pulse motor 24 is controlled by the control means 26.

When the first passageway part 8*c*1 is caused to communicate and not to communicate with the passageway part 8*b*, the rotatable shaft 20 may rotate in one direction or in both directions. The first passageway part 8*c*1 should preferably extend at an obtuse angle $\beta$ (which falls within the range of 100° to 135°), rather than a right angle, with respect to the second passageway part 8*c*2. This is because when the angle between the first passageway part 8*c*1 and the second passageway part 8*c*2 is obtuse, no air will remain at the intersection therebetween.

Figure 4:
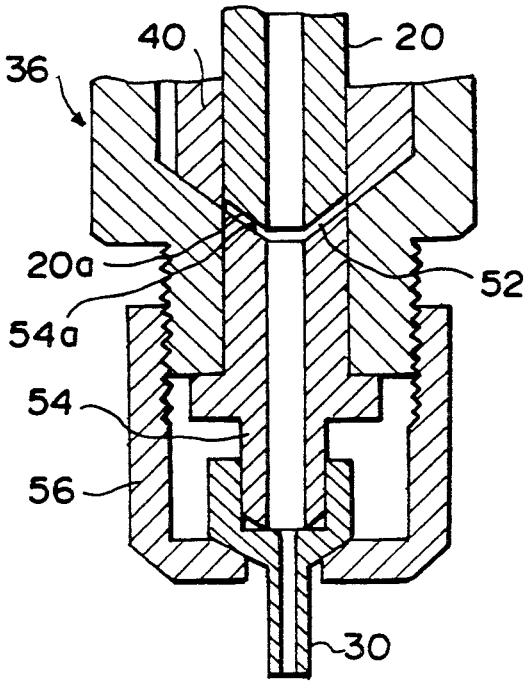
FIG. 4 is an enlarged sectional view showing the major part of another embodiment of the apparatus for delivering a predetermined amount of a fluid in accordance with the present invention.

FIG. 4 is a sectional view showing another embodiment of the apparatus for delivering a predetermined amount of a fluid in accordance with the present invention, wherein the part in the vicinity of the needle 30 in the embodiment of FIG. 2 is improved. In the embodiment of FIG. 2, a slight gap 52 occurs between the lower conical edge surface 20*a* of the rotatable shaft 20 and the inner conical surface 36*d* of the conical part 36*b* of the housing 36. If the adhesive 2 enters the gap 52, troublesome work is required for the adhesive 2 to be removed from the gap 52. Specifically, for this purpose, the rotatable shaft 20 must be removed from the housing 36. However, the rotatable shaft 20 is coupled with the pulse motor 24, or the like, and cannot easily be removed from the housing 36.

In the embodiment of FIG. 4, an adapter 54 is releasably fitted in the lower part of the housing 36. The upper edge of the adapter 54 constitutes an inner conical surface 54*a*, which faces the lower conical edge surface 20*a* of the rotatable shaft 20. Therefore, any adhesive that has entered the gap 52 between the lower conical edge surface 20*a* of the rotatable shaft 20 and the inner conical surface 54*a* of the adapter 54 can be removed easily by removing a cap 56 from the lower part of the housing 36 and then removing the adapter 54 from the housing 36.

Figure 5:
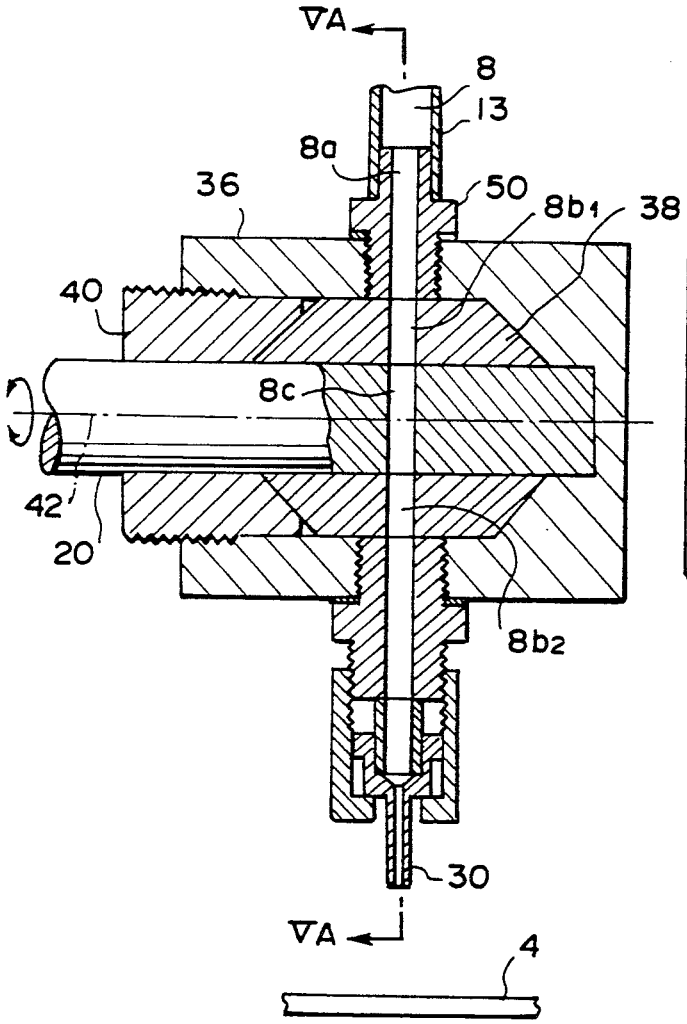
FIG. 5 is an enlarged sectional view showing the major part of a further embodiment of the apparatus for delivering a predetermined amount of a fluid in accordance with the present invention.
Figure 5A:
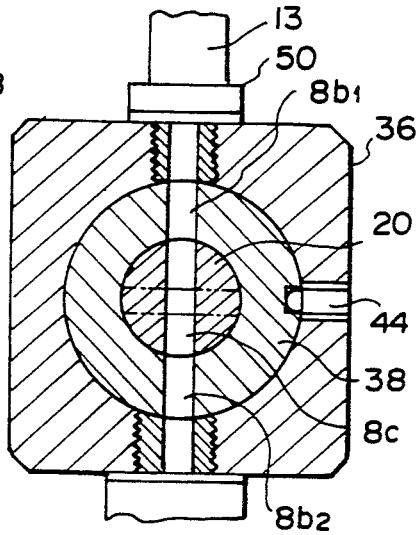
FIG. 5A is a sectional view taken along line VA—VA of FIG. 5.

FIG. 5 is an enlarged sectional view showing the major part of a further embodiment of the apparatus for delivering a predetermined amount of a fluid in accordance with the present invention. FIG. 5A is a sectional view taken along line VA—VA of FIG. 5. In this embodiment, the passageway part 8c formed through the rotatable shaft 20 is constituted of a single through hole, which extends in the radial direction of the rotatable shaft 20. Also, a first passageway part 8b1 and a second passageway part 8b2 are formed through the seal member 38. An adhesive is fed along the radial direction of the rotatable shaft 20 (which direction is normal to the axis 42) and is delivered without the direction of advance of the adhesive being changed. Specifically, when the adhesive is to be delivered, as indicated by the solid line in FIG. 5A, the rotatable shaft 20 is rotated such that its passageway part 8c communicates straightly with the first passageway part 8b1 and the second passageway part 8b2 formed through the seal member 38. When the delivery of the adhesive is to be stopped, the rotatable shaft 20 is rotated by an appropriate angle such that its passageway part 8c does not communicate with the first passageway part 8b1 and the second passageway part 8b2. For example, as indicated by the chained line in FIG. 5A, the rotatable shaft 20 (the passageway part 8c) is rotated by 90°.

In the embodiments described above, the delivery of the adhesive is stopped by rotating the rotatable shaft 20. Therefore, when the delivery of the adhesive is stopped, the adhesive is subjected to no large force (for example, force occurring from a change in pressure due to a change in the volume of a body, such as a fluid pushing edge part of a piston, in the adhesive as in the aforesaid conventional apparatus for delivering a predetermined amount of a fluid). Accordingly, the aforesaid embodiments are free of the problems in that the adhesive falls undesirably and air is sucked into an adhesive outlet part of a needle when the delivery of the adhesive is stopped. As a result, a predetermined amount of the adhesive can be delivered very accurately.

In the aforesaid embodiments, the pulse motor 24 is used to rotate the rotatable shaft 20. Alternatively, the rotatable shaft 20 may be operated with hydraulic or pneumatic pressures.

The method and apparatus for delivering a predetermined amount of a fluid in accordance with the present invention are applicable widely when predetermined amounts of fluids, primarily, predetermined amounts of liquids having various levels of viscosity, are to be delivered.

We claim:

1. A method for delivering a predetermined amount of a fluid wherein the fluid is pressurized and passed through a pressure feed passageway, the pressure feed passageway is opened and closed, and a predetermined amount of the fluid is thereby delivered out of the pressure feed passageway, the method for delivering a predetermined amount of a fluid comprising the steps of:

i) locating a dispenser in said pressure feed passageway, said dispenser comprising a housing with a cylindrical part, a rotatable shaft rotatably disposed within said cylindrical part, and a seal member located between said cylindrical part of said housing and said rotatable shaft, said rotatable shaft being provided with a passageway part formed therethrough, which constitutes part of said pressure feed passageway, and said seal member being provided with a portion of said pressure feed passageway located outside of said passageway part, ii) delivering said fluid by rotating said rotatable shaft to a predetermined orientation, in which said passageway part communicates with said portion of said pressure feed passageway in said seal member and located outside of said passageway part, and iii) after a predetermined amount of said fluid has been delivered, rotating said rotatable shaft by a predetermined angle to an orientation, in which said passageway part does not communicate with said portion of said pressure feed passageway in said seal member and located outside of said passageway part, and thereby stopping the delivery of said fluid.

2. A method as defined in claim 1 wherein said fluid is a liquid.

3. An apparatus for delivering a predetermined amount of a fluid, the apparatus comprising:

i) a means for pressurizing said fluid, ii) a pressure feed passageway through which said pressurized fluid passes, and iii) a dispenser located in said pressure feed passageway, said dispenser being provided with:

a) a rotatable shaft provided with a passageway part formed therethrough, which constitutes part of said pressure feed passageway, b) a cylindrical part of a housing, which cylindrical part is fitted outside of said rotatable shaft such that said rotatable shaft can rotate therein, c) a seal member which is constituted of a resilient material, said seal member being located between said cylindrical part of the housing and said rotatable shaft, said seal member including a portion of said pressure feed passageway passing therethrough and located outside of said passageway part, d) an operation means for rotating said rotatable shaft, and e) a control means for controlling said operation means in order for said rotatable shaft to be rotated to an orientation, in which said passageway part communicates with said portion of said pressure feed passageway passing through said seal member and located outside of said passageway part, and to an orientation, in which said passageway part does not communicate with said portion of said pressure feed passageway passing through said seal member and located outside of said passageway part.

4. An apparatus for delivering a predetermined amount of a fluid, the apparatus comprising:

i) a means for pressurizing said fluid, ii) a pressure feed passageway through which said pressurized fluid passes, and iii) a dispenser located in said pressure feed passageway, said dispenser being provided with:

a) a rotatable shaft provided with a passageway part, which constitutes part of said pressure feed passageway, b) an operation means for rotating said rotatable shaft, and c) a control means for controlling said operation means in order for said rotatable shaft to be rotated to an orientation, in which said passageway part communicates with said pressure feed passageway outside of said passageway part, and to an orientation, in which said passageway part does not communicate with said pressure feed passageway outside of said passageway part;

wherein said dispenser is further provided with:

a cylindrical part of a housing, which cylindrical part is fitted outside of said rotatable shaft such that said rotatable shaft can rotate therein, a seal member which is constituted of a resilient material and has a convex conical edge surface, which edge surface is taken in the axial direction, said seal member being located between said cylindrical part of the housing and said rotatable shaft such that an outer circumferential surface of said seal member is in contact with an inner circumferential surface of said cylindrical part of the housing, and an inner circumferential surface of said seal member is in contact with an outer circumferential surface of said rotatable shaft, and a seal pushing member having a concave conical pushing surface, which corresponds to said convex conical edge surface of said seal member and which pushes said convex conical edge surface of said seal member along the axial direction.

5. An apparatus as defined in claim 4 wherein said dispenser is still further provided with an adapter, which is releasably fitted in a fluid outlet part of said housing.

6. An apparatus as defined in claim 4 wherein said fluid is a liquid.

7. An apparatus as defined in claim 3 wherein said dispenser is further provided with an adapter, which is releasably fitted in a fluid outlet part of said housing.

8. An apparatus as defined in claim 3 wherein said fluid is a liquid.

9. An apparatus as defined in claim 3 wherein said operation means comprises a pulse motor.

10. An apparatus as defined in claim 3 wherein said passageway part, which is formed through said rotatable shaft, comprises a first part, which extends from an outer side surface of said rotatable shaft to the rotation axis of sad rotatable shaft, and a second part which extends from said first part coaxially with the rotation axis of said rotatable shaft and to a lower end of said rotatable shaft.

* * * * *